US006431282B1

(12) United States Patent
Bosma et al.

(10) Patent No.: US 6,431,282 B1
(45) Date of Patent: Aug. 13, 2002

(54) METHOD FOR ANNULAR SEALING

(75) Inventors: Martin Gerards Rene Bosma; Erik Kerst Cornelissen; Wilhelmus Christianus Maria Lohbeck; Franz Marketz, all of Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/543,065

(22) Filed: Apr. 5, 2000

(30) Foreign Application Priority Data

Apr. 9, 1999 (EP) ..... 99302800

(51) Int. Cl.[7] ..... E21B 43/10

(52) U.S. Cl. ..... 166/288; 166/207; 166/295; 166/300; 166/384

(58) Field of Search ..... 166/207, 217, 166/242.2, 242.7, 277, 285, 286, 288, 295, 300, 384; 299/469.5, 523

(56) References Cited

U.S. PATENT DOCUMENTS

| | | | | | |
|---|---|---|---|---|---|
| 2,248,028 | A | * | 7/1941 | Prutton | 166/295 |
| 2,294,294 | A | * | 8/1942 | Grebe | 166/295 |
| 3,126,959 | A | * | 3/1964 | Ortloff | 166/295 X |
| 3,134,442 | A | * | 5/1964 | Jennings | 166/207 |
| 3,191,680 | A | * | 6/1965 | Vincent | 166/207 X |
| 3,297,092 | A | | 1/1967 | Jennings | 166/207 |
| 3,363,301 | A | * | 1/1968 | Delaruelle et al. | 29/469.5 X |
| 3,489,220 | A | * | 1/1970 | Kinley | 166/277 |
| 3,782,466 | A | * | 1/1974 | Lawson et al. | 166/295 |
| 5,337,823 | A | * | 8/1994 | Nobileau | 166/277 |
| 5,667,011 | A | * | 9/1997 | Gill et al. | 166/295 |
| 5,718,288 | A | * | 2/1998 | Bertert et al. | 166/288 X |
| 5,787,984 | A | * | 8/1998 | Mabile | 166/207 X |
| 5,794,702 | A | | 8/1998 | Nobileau | 166/380 |
| 5,833,001 | A | | 11/1998 | Song et al. | 166/287 |
| 5,875,845 | A | * | 3/1999 | Chatterji et al. | 166/295 X |
| 5,964,288 | A | | 10/1999 | Leighton et al. | 166/207 |
| 6,012,522 | A | | 1/2000 | Donnelly et al. | 166/207 X |

FOREIGN PATENT DOCUMENTS

| | | |
|---|---|---|
| EP | 0643794 | 11/1996 |
| WO | 94/09249 | 4/1994 |
| WO | 94/09250 | 4/1994 |
| WO | 94/09252 | 4/1994 |
| WO | 94/19574 | 9/1994 |
| WO | 95/19942 | 7/1995 |
| WO | 97/03489 | 1/1997 |
| WO | 99/02818 | 1/1999 |
| WO | 99/06670 | 2/1999 |
| WO | 99/23046 | 5/1999 |
| WO | 99/33763 | 7/1999 |

OTHER PUBLICATIONS

Engineered Materials Handbook, Desk Edition, 2nd print (1998), ISBN 0–87170–283–5, pp. 251–281.

Specification for Line Pipe (API Specification 5L, Forty–First Edition, Apr. 1, 1995) American Petroleum Institute, 1220 L Street, Northwest Washington D.C., 20005.

Specification for Casing and Tubing (API Specification 5ct Fifth Edition, Apr. 1, 1995) American Petroleum Institute, 1220 L Street, Northwest Washington D.C., 20005.

International Search Report Completed Aug. 1, 2000.

* cited by examiner

*Primary Examiner*—George Suchfield

(57) ABSTRACT

Method for sealing an annulus between two solid tubulars or between a solid tubular and a borehole which comprises the use of a thermoset or thermoplastic material in forming the seal between at least part of the outer surface of a tubular and at least part of the inner surface of the other tubular or the wellbore in which the seal is formed by expanding the inner tubular.

28 Claims, 2 Drawing Sheets

METHOD FOR ANNULAR SEALING

FIELD OF THE INVENTION

The present invention relates to a method for sealing an annulus between tubulars or between a tubular and a borehole.

BACKGROUND OF THE INVENTION

Conventionally, in order to achieve a seal between a tubular and a borehole, the annulus (the gap between the casing and the rock/formation) is subjected to a cementing (or grouting) operation. This treatment is normally referred to a Primary Cementing. The main aspects of primary cementing are to isolate flow between different reservoirs, to withstand the external and internal pressures acting upon the well by offering structural reinforcement and to prevent corrosion of the steel casing by chemically aggressive fluids.

A poor cementing job can result in migration of reservoir fluids, even leading to gas migration through micro-annuli in the well which not only reduces the cost-effectiveness of the well but may cause a "blow out" resulting in considerable damage. Although repair jobs ("secondary cementing") are possible (in essence forcing more cement into the cracks and micro-annuli) they are costly and do not always lead to the desired results.

One of the major drawbacks of the use of traditional cementing materials such as Class G cement (e.g. OPC: Ordinary Portland Cement) is that such materials cannot achieve a gas tight seal due to the inherent shrinkage of the materials. Shrinkage is typically in the order of 4–6% by volume which causes gas migration through the micro-annuli created because of the shrinkage.

It has been proposed in the art to use a mixture of a slurry of a hydraulic cement and a rubber component in order to improve on the ordinary sealing properties of the conventional cementing materials. However, the intrinsic properties of the conventional cementing material still play a part in such sealing techniques.

Cementing can also be carried out between two tubulars, e.g. in order to fix a corroded or damaged pipe or for upgrading the strength of a packed pipe.

A technique known in the oil industry as expansion of well tubulars, normally introduced to complete an uncased section of a borehole in an underground formation, has as one of its features that it narrows the gap between the outer surface of the tubular and the casing and/or rock/formation it faces. However, it is not envisaged and in practice impossible to provide even a small sealing effect during such expansion operation.

In European patent specification 643,794 a method is disclosed for expanding a casing against the wall of an underground borehole wherein the casing is made of a malleable material which preferably is capable of plastic deformation of at least 25% uniaxial strain and the casing may be expanded by an expansion mandrel which is pumped or pushed through the casing. Again, it is not envisaged and in practice impossible to provide even a small sealing operation during such expansion operation.

It is also known in the art that tubulars can be provided with coatings (also referred to as "claddings") which are normally applied in order to increase the resistance of the tubulars against the negative impact of drilling fluids and other circulating materials (e.g. fracturing agents or aggressive oil field brines). Again, such provisions are not designed to obtain any improvement with respect to sealing.

Recently, in International Patent Application WO99/02818 a downhole tubing system has been proposed which in essence is based on a radially expandable slotted tubular body carrying deformable material on the exterior thereof and a seal member within the tubular body and for engaging an inner surface of said body. It is specifically stated that there should be, of course, no elastomer-to-rock contact at the positions of the slots as the inflow of oil should not be interrupted.

Therefore, the system as described in WO99/02818 has to be regarded as a system which allows flow of fluid at certain places (envisaged because of the presence of the slots) and not in others which is achieved by the combination of three elements: the use of an expandable tube, the presence of a deformable material on the exterior of the tubular body and the use of a seal member inside the expandable slotted tubular body.

There is no reference in the description of WO99/02818 to expandable solid tubulars.

In recently published International Patent Application WO99/06670 reference is made to a method for creating zonal isolation between the exterior and interior of an uncased section of an underground well system which is located adjacent to a well section in which a casing is present. The zonal isolation is obtained by inserting an expandable tubular through the existing well casing into an uncased section, such as a lateral branch, of the underground well system and subsequently expanding the expandable tubular such that one end is pressed towards the wall of the uncased section of the well system and the outer surface of the other end is pressed against the inner surface of the well thereby creating an interference fit capable of achieving a shear bond and an hydraulic seal between said surrounding surfaces. It is possible to insert a gasket material between the surrounding surfaces before expanding the tubular.

It will be clear that the method proposed in International Patent Application WO99/06670 is aimed particularly at machined tubulars which are rather regular and the hydraulic seals formed are useful because of the concentric nature of the surrounding surfaces.

It has now been realised that under more demanding conditions, in particular when the tubulars or a tubular and borehole are less concentric with respect to each other and may also vary in radial dimensions, providing adequate seals by straight forward expansion, even when using a gasket, is no longer possible. Even systems which were initially well sealed because of the concentric, or substantially concentric nature of the tubulars or the tubular and the borehole, will deteriorate with time due to a variety of circumstances such as corrosion, displacement forces and the like. This means that there is a need to devise a sealing system which can operate under practical conditions and, preferably over rather long distances. Moreover, such sealing system should be capable of performing its sealing duty over a long period of time during which conditions may vary as discussed hereinabove.

SUMMARY OF THE INVENTION

A method has now been found which allows the formation of good quality seals when use is made of the expanding feature of an expandable tubular to provide a sealing based on thermoset or thermoplastic material.

The present invention therefore relates to a method for sealing an annulus between two solid tubulars or between a solid tubular and a borehole which comprises the use of a thermoset or thermoplastic material in forming the seal between at least part of the outer surface of a tubular and at least part of the inner surface of the other tubular or the wellbore in which the seal is formed by expanding the inner tubular.

DETAILED DESCRIPTION

Figure 1:
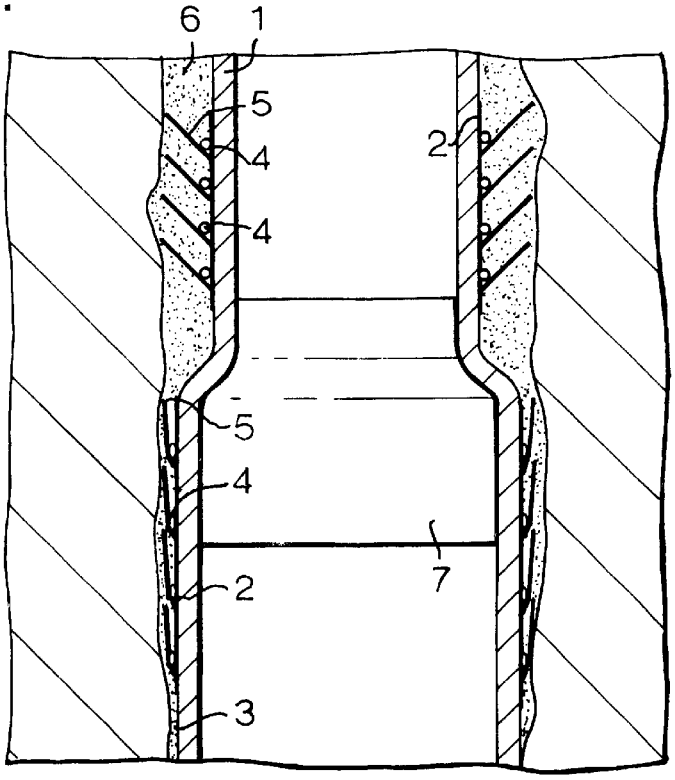
FIG. 1 schematically shows a partially expanded tubular around which a pair of thermoplastic or thermosetting sleeves are arranged in which a series of tangential burstable containers are embedded, and which burst as a result of the tubular expansion.
Figure 3:
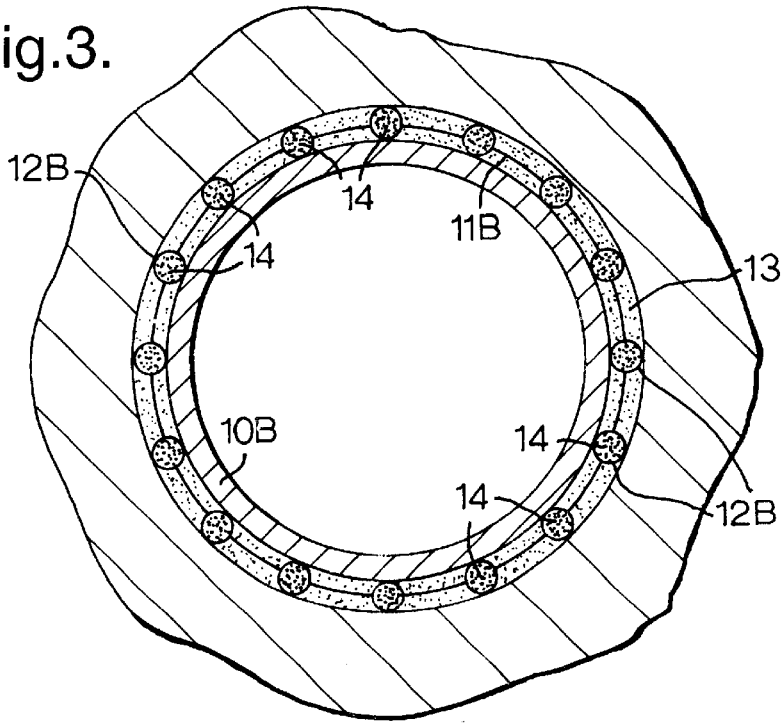
FIG. 3 is a top view of the tubular assembly of FIG. 2.

The thermoset and thermoplastic materials to be used to bring about the seal between tubulars or between a tubular and a wellbore are defined for the purpose of this invention as amorphous polymeric materials which are in the glassy and/or rubbery state. The aggregation status of amorphous polymeric materials can be defined in general in relation to temperature with help of their rigidity since rigidity is the most important parameter with respect to differences in aggregation.

Rigidity is the force required to effect a certain deformation. When taking the force per unit of surface of the cross-section (tension s) and expressing the deformation (e) as a function of initial length (l) as $e=\Delta l/l$, rigidity is the quotient of these two moieties, also indicated as the elasticity modulus and expressed as $E=s/e$. For each polymeric material a graph between log E (y-axis) and temperature (x-axis) can be construed showing the three areas and the respective transition points. The three areas are glass (lowest temperature, highest E), rubbery (lower E and higher temperature) and liquid (lowest E and highest temperature). The transition points are normally referred to as glass transition point (Tg) and melt transition point (Tm).

The materials envisaged for the formation of seals within the ambit of the present invention are of glassy and/or rubbery nature prior to expansion and good performance will be obtained when they maintain completely or to a large extent that nature. It is possible that, because of the temperature regime, also influenced by the friction forces released during expansion, part or all of a glassy-type material is converted to its rubbery stage. For certain materials this can even be an advantage from a sealing point of view as the elasticity modulus for rubbery-type materials can be 100–1000 times lower than for the same material in its glassy-type status.

To some extent, the amorphous polymeric materials may have some degree of crystallinity. The impact of crystalline material is small on glassy-type materials, in particular on the mechanical properties thereof and larger on rubbery-type materials as such materials delay transition into the rubbery status.

It is also possible to use bitumen-containing polymeric materials to provide for the seals in accordance with the present invention. Commercially available bitumen-containing elastomers can be used advantageously as sealable materials.

Examples of amorphous polymers which can be used in the method according to the present invention are butadiene and isoprene rubber which have a rubbery status at ambient temperature which will be even more so when they have been vulcanised. Materials like PVC and polystyrene are representative for glassy-type materials at ambient temperature. Copolymers of rubbery and glassy materials are also of interest; their properties will be determined primarily by the relative contribution of the appropriate homo-polymers.

Suitably, the materials to be used in the formation of the seals can be present already as claddings on the outer surface of the (inner) tubular to be expanded. The thickness of the coating may vary depending on the type of material envisaged, the annulus to be sealed and the expansion strength to be exerted. Coatings in the range of 0.02–10 cm can be suitably applied. Good results have been obtained on a small scale with coatings having a thickness in the range 0.05–2 cm.

The claddings may be present over all or part of the outer surface of the tubular to be expanded and they may also contain protrudings or recesses, in particular when an annulus is to be sealed of in various areas over the length of the tubular.

Sealing is achieved when both axial and radial flow are substantially or totally prevented. An additional advantage of the sealing method according to the present invention is that, in the event of a seal between a tubular and a casing, the initial collapse rate of the system is nearly or even completely restored. Known sealing gadgets (of limited length) have only marginal ability to restore the Collapse Rating of an initial completion, irrespective of the fact that such gadgets can be applied properly when only marginal stresses are involved (such as in the shut off of watered out sections of horizontal wells).

The present invention comprises a number of alternative solutions which can be used depending on the type of underground formation encountered and the amount of sealing actually required or preferred.

In principle it is possible to construe a continuous seal between the outer surface of a tubular and the inner surface of the other tubular or the wellbore, as the case may be (i.e. the total outer surface of the tubular is involved in the seal) but often it is enough, or even preferred, to construe seals only at certain parts of the total (downhole) outer surface of the tubular which leads to zonal isolation. When, in the context of this description the expression "at least a part of the outer surface" is referred to it both includes total as well as zonal isolation (unless otherwise identified).

It has been found that the method according to the present invention allows for the formation of seals over extended distances, for instance more than 15 meter, in particular more than 25 meter and suitable over much longer distances which can reach into hundreds of meters. Smaller distances are possible as well but the method is particularly suitable for sealing large distances. It should be noted that conventional packers have maximum lengths of about 13 meters (about 40 feet). It is also possible to provide zonal isolation for certain areas of the tubular involved or to produce seals which are alternated with non-sealed areas.

In a first embodiment of the method according to the present invention, which is of particular advantage for providing seals in the context of boreholes having a substantially circular cross-section (sometimes referred to as "gun barrel shaped"), the seal is formed by bringing an expandable tubular cladded at least partly with a thermoset or thermoplastic material into the borehole followed by expansion of the tubular.

Conventional elastomers can suitably be used for this type of application. For instance, nitrile rubbers are eminently suitable for low to modest temperature applications. Low duty fluoro-elastomers (e.g. VITON (VITON is a Trademark)) can be applied for more demanding conditions. "Special Service" fluoro-elastomers would be applied in extremely hostile conditions. Examples of suitable fluoro-elastomers are for instance materials referred to as AFLAS or KALREZ (AFLAS and KALREZ are Trademarks). Silicones and fluorosilicones are further examples of materials which can be used suitably in the method for annular sealing in accordance with the present invention.

The elastomeric materials can be coated to the tubulars to be used by methods known in the art which are not elucidated here in any detail such as conventional compounding techniques, e.g. such as applied in the manufacture of electrical cables.

It is possible to enhance the compressibility of the elastomeric materials envisaged by incorporating therein so-called closed cell structures, in particular when use is envisaged in shallow operations, or expanded, malleable microbubbles. Such, in essence hollow, microspheres act like minute balloons which provide additional compressibility of the elastomer during the expansion process and compensate for the volume changes due to partial retraction of the tubing after the expansion process. Examples of suitable materials include EXPANCELL and MICROSPHERE FE (EXPANCELL and MICROSPHERE FE are Trademarks). These applications are particularly suitable when sealing an annulus between tubulars at low pressure.

In a second embodiment of the method according to the present invention, which is of particular advantage for providing seals in the context of boreholes having a substantial elliptical shape but without having extensive washouts or other gross diameter changes, the elastomeric seal is formed by bringing an expandable tubular cladded at least partly with a thermoplastic elastomer into the borehole followed by expansion of the tubular.

In such situations it appears that rather than a conventional thermoset elastomer (of which in essence the shape cannot be changed after vulcanisation by melting) a thermoplastic elastomer should be used. The process is preferably applied in such a way that heating is applied to the well when the expansion process is being performed. It is also possible to use glassy-type materials in these situations.

Thermoplastic elastomers which can be suitably applied in this particular embodiment include vulcanised EPDM/polypropylene blends such as SARLINK® (a registered trademark of Novacor Chemicals Ltd.) or polyether ethers and polyether esters such as, for instance, ARNITEL® (a registered trademark of Enka B.V.).

Heating of the well before and/or during the expansion process can be carried out by any convenient heating technique. Examples of such techniques include the use of a hot liquid, preferably a circulating hot liquid which can be reheated by conventional techniques, the use of heat produced by the appropriate chemical reaction(s) or the use of electricity to generate heat in the underground formation. The result of applying heat will be that the thermoplastic elastomer, being in or being converted into the semi-solid state will have better opportunities to fill the more irregular cross-sections of the wellbore and also to a much larger extent.

Again, it is possible to increase the compressibility of the thermoplastic elastomers envisaged by using expanded, malleable microbubbles as fillers, provided that their hulls remain substantially intact during the melting stage of the thermoplastic elastomers applied during the expansion process. Micro-balloons having a hull of nylon can be applied advantageously.

In a third embodiment of the method according to the present invention, which is of particular advantage for providing seals in the context of so-called "open hole" sections, i.e. sections in which the tubular will be placed being highly irregular (sometimes referred to as large washout and/or caved-in sections), the elastomeric seal is formed by placing an in-situ vulcanising elastomer system into the wellbore, which elastomer is then subjected to the expansion of the tubular present in the borehole. It is also possible to use materials which are predominantly in the glassy state such as the partly saturated polyesters (such as the appropriate vinylesters), epoxy resins, diallylphthalate esters (suitable materials comprise those referred to as DAP (the "ortho" resin) and DAIP (the "meta" resin), amino-type formaldehydes (such as ureumformaldehyde and melamineformaldehyde), cyanate esters and thermoset polyimides (such as bismaleimides) and any other thermosetting esters.

In a preferred embodiment, use is made of an in-situ vulcanisable two component system to produce the appropriate seal. There are a number of ways to obtain the envisaged seal.

In a first mode, it is envisaged to fill the annular void with the (liquid) two component system and allowing the tubular (provided with a non-return valve) to dip into the two component system and allowing the system to set where after the expansion process of the tubular is carried out.

In a second mode, it is envisaged to carry out the expansion process of the tubular prior to the setting of the two component system. The tubular expansion system is performed in this situation in the so-called "bottom-up" mode, thereby forcing the not yet set elastomer solution into the micro-annuli to create a "rubber gasket".

Suitable materials for this mode of operation in which an in-situ vulcanising elastomer system is used are the so-called RTV (Room Temperature Vulcanisable) two component silicone rubbers which can be suitably retarded for the elevated temperatures and pressures often encountered in oil and/or gas wells. Reference is made in this context to materials commercially available from Dow Corning and identified as 3-4225, 3-4230, 3-4231, 3-4232 and 4–4234. It is believed that these materials can be used advantageously in view of their so-called "addition-curing properties". It is also possible to use elastomeric compounds based on epoxy-compounds such as the WellSeal range of products which is commercially available from Shell.

For specific definitions of the classes of compounds referred to hereinabove, reference is made to Engineered Materials Handbook, Desk Edition, 2nd print (1998), ISBN 0-87170-283-5, pages 251–281.

Once again, it is possible to pre-stress the elastomeric gasket to be produced by inflating it either by a built-in "chemical blowing agent" such as GENITOR® (a registered trademark of Genitor Corporation) or by using malleable microbubbles containing a volatile liquid such as Expancell DU. Also fillers which are more voluminous because of a solid/solid or solid/liquid transformation at elevated temperature can be suitably applied.

It is one of the advantages of the process according to the present invention that use can be made of reelable or reeled tubular which has important advantages from, inter alia, a logistics point of view. As stated herein before, it is highly useful to apply expandable tubulars in reelable or reeled form which has been provided with cladding, either on the total outer surface of the tubular to be applied or on specific parts of the outer surface when the tubular is to be used in zonal isolation duty, already at the manufacturing stage.

It is also possible, and, in fact preferred, to apply reelable or reeled tubular containing in the appropriate cladding already electrical cables and/or hydraulic lines which can be used to allow remote sensing and/or control of processes envisaged to be carried out when the tubular is used in proper production mode. In the in-situ vulcanising mode, it is possible to have (armoured) cables and/or lines present attached to the exterior of the reelable or reeled tubular in order to allow telemetric and/or well control activities.

The method according to the present invention can be suitably applied in repairing or upgrading damaged or worn out tubulars, in particular pipes. A convenient method comprises providing part or all of the pipe to be upgraded with in inner pipe and providing a seal in accordance with the method according to the present invention by expanding the inner pipe and thereby providing the seal using the thermoset or thermoplastic material as defined hereinbefore as the material(s) which form the seal because of the expansion of the inner pipe.

The expansion of the tubular which is mandatory in obtaining the elastomeric seal as described herein above, can be carried out conveniently as described in the state of the art. Reference is made, inter alia to patent application publication WO97/03489 in which the expansion of a tubular, in particular of a tubular made of a steel grade which is subject to strain hardening as a result of the expansion process, is described.

The process of expansion is in essence directed to moving through a tubular (sometimes referred to as a "liner") an expansion mandrel which is tapered in the direction in which the mandrel is moved through the tubular, which mandrel has a largest diameter which is larger than the inner diameter of the tubular. By moving the mandrel through the tubular it will be appreciated that the diameter of the tubular is enlarged. This can be done by pushing an expansion mandrel downwardly through the tubular; or, more suitably, by pulling upwardly through the tubular an expansion mandrel which is tapered upwardly.

Suitably, the expansion mandrel contains an expansion section that has a conical ceramic outer surface and a sealing section which is located at such distance from the expansion section that when the mandrel is pumped through the tubular the sealing section engages a plastically expanded part of the tubular. It is also possible to use a mandrel containing heating means in order to facilitate the expansion process.

The use of a ceramic conical surface reduces friction forces during the expansion process and by having a sealing section which engages the expanded tubular it is avoided that hydraulic forces would result in an excessive expansion of the tubular. In such cases it is preferred that the expansion mandrel contains a vent line for venting any fluids that are present in the borehole and tubing ahead of the expansion mandrel to the surface.

In general, it is advantageous to use mandrels having a semi-top angle between 15° and 30° in order to prevent either excessive friction forces (at smaller angles) or undue heat dissipation and disruptions in the forward movement of the device (at higher angles). For certain applications, in particular in the event of "end sealing", it may be useful to apply mandrels having a smaller cone angle. Suitable cone semi-top angles are between 10° and 15°. Small cone angles are beneficial for expanding internally-flush mechanical connections by mitigating the effect of plastic bending and, thereby, ensuring that the expanded connection is internally flush.

An inherent feature of the expansion process by means of propelling a mandrel is that the inner diameter of the expanded tube is generally larger than the maximum outer diameter of the mandrel. This excess deformation is denoted as surplus expansion. Surplus expansion can be increased by designing the mandrel with a parabolic or elliptical shape, thereby increasing the initial opening angle of the cone to a maximum of 50° whilst keeping the average semi-top angle between 15 and 30°. The surplus expansion can be increased about 5 times. This in fact allows to increase the interfacial pressure between the expanded tube and the rubber sealing element and increases the annular sealing capacity.

The tubular can be expanded such that the outer diameter of the expanded tubular is slightly smaller than the internal of the borehole or of any casing that is present in the borehole and any fluids that are present in the borehole and tubular ahead of the expansion mandrel are axially displaced upwardly via the annular space that is still available above the seal just created or being created by the expanding action of the mandrel whilst pulled up through the tubular.

The invention also relates to a well provided with a tubular which is sealed by the method according to the present invention. In such case the tubular may serve as a production tubular through which hydrocarbon fluid is transported to the surface and through which optionally a, preferably reelable, service and/or kill line is passed over at least a substantial part of the length of the tubular, allowing fluid to be pumped down towards the bottom of the borehole while hydrocarbon fluid is produced via the surrounding production tubular.

As discussed hereinabove, the method according to the present invention is particularly useful for sealing an annulus between two solid tubulars or between a solid tubular and a borehole when at least one of the tubulars, or the tubular or the borehole as the case may be, is less concentric and possibly also variable in radial dimensions so that a straight forward sealing operation based on achieving a shear bond and a hydraulic seal is no longer adequate, even when use is made of a gasket material as described in International Patent Application WO99/06670.

The specifications of diameters of pipes, tubulars and casings are normally given with their manufacturing tolerances. Reference is made to the publications by the American Petroleum Institute, 1220 L Street, Northwest Washington D.C., 20005: Specification for Line Pipe (API SPECIFICATION 5L, FORTY-FIRST EDITION, Apr. 1, 1995) and Specification for Casing and Tubing (API SPECIFICATION 5CT FITFH EDITION, Apr. 1, 1995). In general, the tolerances have been set at at most 1% of the appropriate diameter. The method according to the present invention can be applied suitably when materials (tubulars or tubulars and casings) are involved which deviate 50% or more from the normal tolerance as given by the manufacturer. It will be clear that larger deviations will frequently occur under field conditions and that the method according to the present invention becomes of greater economic importance when the deviations become larger. Deviations of more than 200%, or more than 500%, or even at least 1000% of the initial tolerances given will frequently occur and call for providing seals in accordance with the method according to the present invention.

The invention will now be illustrated by means of the following, non-limiting examples.

EXAMPLE 1

A test cell was used having a length of 30 cm and provided with a 1 inch (2.54 cm) diameter expandable tubular (prior to expansion) in a 1.5 inch (3.81 cm) annulus. The expandable tubular was cladded with a 2 mm thick coating of SARLINK (SARLINK is a Trademark). The expansion was carried out by pushing a mandrel through the expandable tubing at ambient temperature. The strength of the seal produced was tested by increasing pressure up to the point that leakage occurred. The annular seal produced could withstand a pressure of 30 bar at ambient temperature. This means that a specific pressure differential of up to about 100 bar/m could be achieved.

EXAMPLE 2

The test as described in Example 1 was repeated but now using an expandable tubular which was coated with a coating of a thickness of 1.5 mm EVA/Polyolefin material, commercially available as Henkel Hot Melt Adhesive. The expansion was carried out by pushing the mandrel through the expandable tubing at an expansion temperature of 150° C. After cooling down, the strength of the seal produced was tested by increasing pressure up to the point that leakage occurred. The annular seal produced could. withstand a pressure of 80 bar at 20° C. This means that a specific pressure differential of up to about 250 bar/m could be achieved.

EXAMPLE 3

A larger scale experiment was performed using an 80 cm 4 inch (9.16 cm) outer diameter seamless tubular having a 5.7 mm wall thickness and as a casing an 80 cm 5.25 inch (13.33 cm) outer diameter seamless tubular having a 7.2 mm wall thickness. The outer diameter of the cone of the mandrel was 10.60 cm. 4 areas of the outer surface of the tubular were cladded with natural rubber having a thickness (not stretched) of 1 mm and a width (not stretched) of 10 mm. The force exerted to the cone was 29 tonnes. In the pressure test the seal held 7 bar net air pressure.

As the presence of paint layers on the outer surface of the tubular could well have a negative impact on the sealing capabilities, the experiment was repeated using a similar tubular but subjecting it first to machine cleaning which caused removal of 0.5 mm of the initial wall thickness, giving a new outer diameter of 10.10 cm. After the same expansion procedure, no leakage was found at 7 bar net air pressure. When subjecting the seal to a nitrogen pressure test no pressure drop was measured during 15 minutes exposure to 100 bar nitrogen pressure.

In a fourth embodiment of the method according to the present invention, which is of particular advantage for providing seals in the context of so-called "open hole" sections, i.e. sections in which the tubular will be placed being highly irregular (sometimes referred to as large wash-out and/or caved-in sections), one can also use a special version of a thermoplastic or thermoset elastomer sealing element in which metal or glass containers are incorporated, which contain a chemical solution.

Typical designs of said fourth embodiment are given in the drawings. FIG. 1 illustrates that during the expansion process of the metal base pipe 1 by a mandrel 7, two simultaneous processes will occur: 1) the elastomer thermosetting or thermoplastic packing element 2 having ring-shaped fins 5 will be compressed against the borehole wall 3 and might provide a seal, provided the hole would be perfectly round and of a well defined diameter (as described in the first embodiment) and 2) concurrently, the burstable containers formed by a series of tangential tubes 4, embedded in the packing element and containing a chemical solution will burst as a result of the expansion process and emit their content into the stagnant completion or drilling fluid present in the annulus 6 between the borehole wall 3 and the expanded pipe 1.

Examples of such systems are the mud to cement conversion processes (as e.g. described in International patent applications WO 94/09249, WO 94/09250, WO 94/09252, WO 94/19574, WO 99/23046 and WO 99/33763).

Other (Portland, Aluminate or Blast Furnace Slag cement based) systems which could be used as well, are those described by e.g. BJ Services as 'storable cement systems', which are described in International patent applications WO 95/19942 and WO/27122, which typically are also activated (i.e. induced to set) by the addition of a chemical activator.

Two component resin systems are also applicable such as the partly saturated polyesters (e.g. the appropriate vinylesters), diallylphthalate esters (suitable materials comprise those referred to as DAP (the "ortho" resin) and DAIP (the "meta" resin), cyanate esters and any other thermosetting esters, amino-type formaldehydes (such as ureumformaldehyde and melamineformaldehyde), and thermoset polyimides (such as bismaleimides) and epoxy resins. Typically, the tubes 4 would contain the activating agent (crosss-linker) whilst the 'completion fluid' that fills the annulus 6 between the metal pipe 1 and the borehole wall 3 would constitute the other reagent of the two component system.

Alternatively the annulus 6 between the metal pipe 1 and the borehole wall 3 comprises an in-situ vulcanisable two component siloxane and fluorsiloxane systems such as e.g. the product DC-4230, marketed by the Dow Corning Company, Midland, USA, which typically can be made to react by the addition of a (e.g. platinum vinyisiloxane) catalyst to induce a latent elastomer present in the well to set into a solid rubber sealing mass.

The above chemical systems have only been given as examples of combining mechanical gasketing operations with chemical solidifying processes. As such hydraulically latent drilling fluids or completion fluids will be converted into solid, gas sealing barriers. Those barriers are directly resulting from the mechanical tubular expansion process, which induces an activator to be expelled out of axial or radial containers embedded in elastomer packing elements and is therefore directly linked to the mechanical tubing expansion process.

Figure 2:
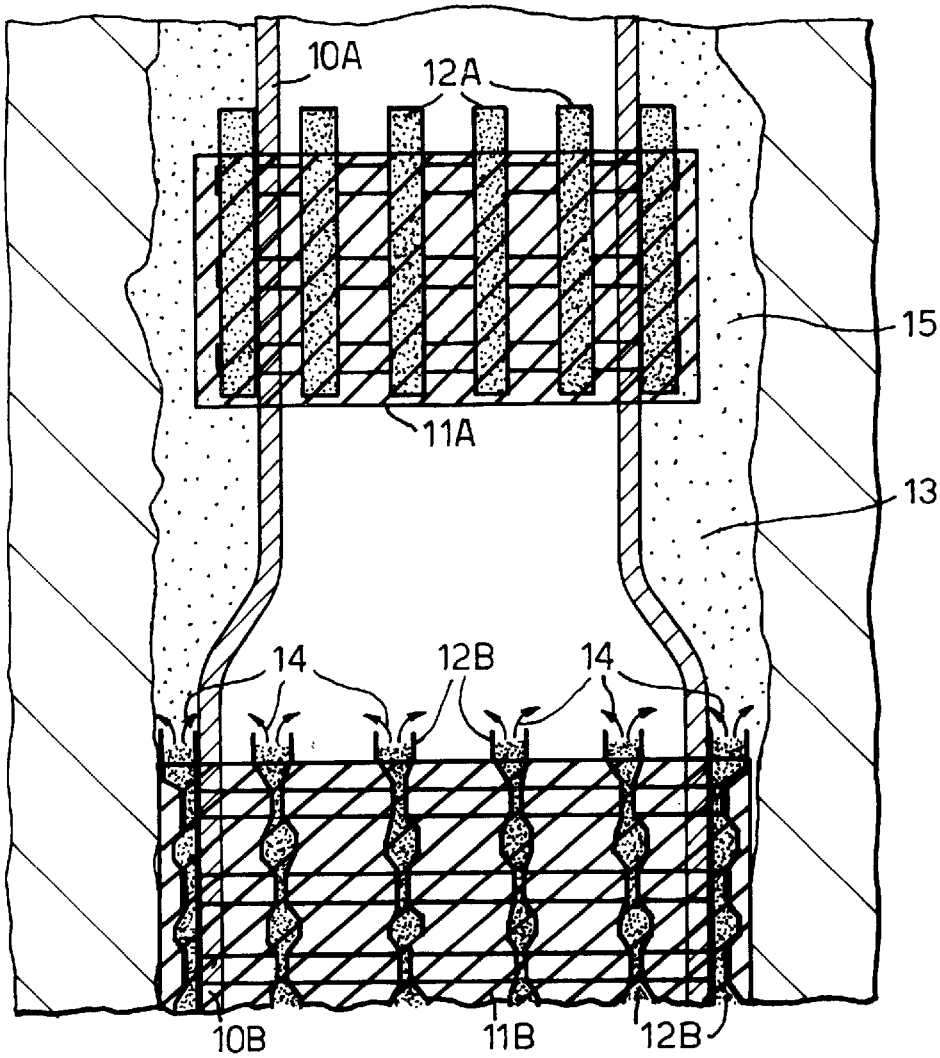
FIG. 2 schematically shows a partially expanded tubular around which a pair of thermoplastic or thermosetting sleeves are arranged in which a series of axially oriented burstable containers are embedded which burst as a result of the tubular expansion.

Referring now to FIG. 2 there is shown an expandable tubular 10 of which the upper portion 10A is unexpanded and the lower portion 10B has been expanded.

The upper tubular portion 10A is surrounded by an elastomer thermosetting or thermoplastic packing element 11A in which a series of axially oriented burstable containers 12A are embedded. The lower tubular portion 10B has been expanded and is surrounded by another thermosetting or thermoplastic packing element 11B in which a series of axially oriented burstable containers 12B are embedded which are squeezed flat as a result of the expansion process so that a chemical activator 14 is released into the pipe-formation annulus 13. The annulus 13 is filled with a liquid cement or other chemical composition 15 which solidifies as a result of the reaction with the activator 14. If the reaction is exothermic and the packing element 11B comprises a thermosetting material, the packing element 11B will also solidify so that a robust fluid tight seal is created in the pipe-formation annulus 13, which seal is only established after expansion of the tubular 10 and which does not require the tubular installation and expansion process to take place within a predetermined period of time as is the case when conventional cementing procedures would be applied.

We claim:

1. Method for sealing an annulus between two solid tubulars or between a solid tubular and a borehole which comprises placing a thermoset or thermoplastic material between at least part of an outer surface of an expandable inner tubular and at least part of an inner surface of an outer tubular or the wellbore; and forming a seal by expanding the inner tubular against said thermoset or thermoplastic material; wherein one or more of the solid tubulars are reeled tubulars; and wherein said one or more of the solid tubulars are at least partially coated with an elastomer; and wherein electrical cables and/or hydraulic lines are present in the elastomeric coating.

2. Method according to claim 1, wherein said expandable tubular is at least partly cladded with an elastomer, in which the seal is formed by bringing said expandable tubular into a borehole followed by expansion of the tubular.

3. Method according to claim 1, wherein one said expandable tubular is at least partly cladded with an elastomer, in which the seal is formed by bringing said expandable tubular into another tubular followed by expansion of said expandable tubular.

4. Method according to claim 1, in which said thermoset or thermoplastic material is an elastomer containing a closed cell structure.

5. Method according to claim 1, in which said thermoset or thermoplastic material is an elastomer also containing expanded, malleable microbubbles.

6. Method according to claim 1, wherein said expandable tubular is at least partly cladded with a thermoplastic elastomer, in which the seal is formed by bringing said expandable tubular into the borehole or into another tubular followed by expansion of the expandable tubular.

7. Method according to claim 6, in which at least part of the wellbore or the other tubular is heated before and/or during expansion of the tubular.

8. Method according to claim 7, in which heating is provided by means of a hot liquid, a chemical reaction or by electricity.

9. Method according to claim 6, in which said thermoset or thermoplastic material is an elastomer also containing expanded, malleable microbubbles.

10. Method according to claim 1, in which the seal is provided by placing an in-situ vulcanising elastomer into the wellbore or into another tubular, followed by expanding the expandable tubular.

11. Method according to claim 10, in which a two component room temperature vulcanisable elastomer is used to provide the seal.

12. Method according to claim 10, in which setting of the elastomer is carried out prior to the tubular expansion.

13. Method according to claim 10, in which setting of the elastomer is completed after the tubular expansion.

14. Method according to claim 10, in which use is made of a room temperature vulcanisable silicone rubber.

15. Method according to claim 10, in which said thermoset or thermoplastic material is an elastomer also containing a chemical blowing agent and/or expanded malleable microbubbles.

16. Method for sealing an annulus between two solid tubulars or between a solid tubular and a borehole which comprises placing a, thermoset or thermoplastic material between at least part of an outer surface of an expandable tubular and at least part of an inner surface of an outer tubular or the wellbore; and forming a seal by expanding the inner tubular against said thermoset or thermoplastic material, in which at least a section of the expandable tubular is surrounded by a sleeve comprising a thermoplastic or thermoset material in which a number of burstable containers are embedded, which containers comprise a chemical activator which is released into the annular space surrounding the expanded tubular and which activator reacts with a cement or other chemical composition and/or the sleeve such that said chemical composition and/or the sleeve solidifies in response to the tubular expansion.

17. Method according to claim 16, in which of the inner tubular is expanded by use of a mandrel having a frustoconical, parabolic or elliptical shape.

18. Method according to claim 16, wherein said mandrel is heated.

19. Method according to claim 1, in which the seal is provided between tubulars or between a tubular and a borehole when the deviation from the tolerance of the tubular as set by the manufacturer is at least 50% of the tolerance set.

20. Method according to claim 19, in which the deviation of the tolerance is at least 200% of the tolerance set.

21. Method according to claim 20, in which the deviation of the tolerance is at least 1000% of the tolerance set.

22. A well provided with a tubular sealed according to claim 1, wherein the tubular serves as a production tubular through which hydrocarbon fluid is transported to the surface and through which optionally a service and/or kill line passes over at least a substantial part of the length of the tubular, through which line fluid can be pumped towards the bottom of the borehole while hydrocarbon fluid is produced via the surrounding production tubular.

23. A tubular provided with an inner tubular sealed to said outer tubular according to claim 1, wherein the inner tubular serves as a transportation means for transportable fluids.

24. Method according to claim 16, in which the seal is provided between tubulars or between a tubular and a borehole when the deviation from the tolerance of the tubular as set by the manufacturer is at least 50% of the tolerance set.

25. Method according to claim 24, in which the deviation of the tolerance is at least 200% of the tolerance set.

26. Method according to claim 25, in which the deviation of the tolerance is at least 1000% of the tolerance set.

27. A well provided with a tubular sealed according to claim 16, wherein the tubular serves as a production tubular through which hydrocarbon fluid is transported to the surface and through which optionally a service and/or kill line passes over at least a substantial part of the length of the tubular, through which line fluid can be pumped towards the bottom of the borehole while hydrocarbon fluid is produced via the surrounding production tubular.

28. A tubular provided with an inner tubular sealed to said outer tubular according to claim 16, wherein the inner tubular serves as a transportation means for transportable fluids.

* * * * *

UNITED STATES PATENT AND TRADEMARK OFFICE

CERTIFICATE OF CORRECTION

PATENT NO. : 6,431,282 B1 
DATED : August 13, 2002
INVENTOR(S) : Martin Gerards Rene Bosma et al.

It is certified that error appears in the above-identified patent and that said Letters Patent is hereby corrected as shown below:

Column 11,
Line 62, please delete the comma which appears between the words "a" and "thermoset."

Signed and Sealed this

Eleventh Day of February, 2003

JAMES E. ROGAN
*Director of the United States Patent and Trademark Office*